US007232124B2

(12) United States Patent
Koh et al.

(10) Patent No.: US 7,232,124 B2
(45) Date of Patent: Jun. 19, 2007

(54) SHEET SEPARATOR

(75) Inventors: Seng San Koh, Singapore (SG); Cherng Linn Teo, Singapore (SG); Pui Wen Huang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 462 days.

(21) Appl. No.: 10/860,827

(22) Filed: Jun. 3, 2004

(65) Prior Publication Data

US 2005/0269762 A1 Dec. 8, 2005

(51) Int. Cl.
*B65H 3/52* (2006.01)

(52) U.S. Cl. ..... 271/125; 271/117; 271/118; 271/119; 271/121; 271/122; 271/124

(58) Field of Classification Search ..... 271/121, 271/114, 116, 117, 119, 118, 124, 122, 125
See application file for complete search history.

(56) References Cited

U.S. PATENT DOCUMENTS 3,127,181 A * 3/1964 Crego et al. ..... 277/411
5,145,160 A * 9/1992 Nagashima et al. ..... 271/9.09
5,178,378 A * 1/1993 Nakajima ..... 271/116
5,211,388 A * 5/1993 Walluk ..... 271/122
5,890,395 A * 4/1999 Kawata et al. ..... 74/431
5,996,990 A * 12/1999 Kawashima ..... 271/122
6,059,281 A * 5/2000 Nakamura et al. ..... 271/119
6,070,867 A * 6/2000 Tsurumi et al. ..... 271/114
6,869,070 B2 * 3/2005 Shimamura et al. ..... 271/121

* cited by examiner

*Primary Examiner*—Patrick Mackey
*Assistant Examiner*—Gerald McClain

(57) ABSTRACT

A sheet separator includes an advancing roller driven to rotate to move a sheet forwards along a sheet path, and a reversing roller driven to rotate to move a sheet backwards along the path. The reversing roller and advancing roller are mounted adjacently and are relatively movable between a pinched position and a separated position. The reversing roller has a torque limiter for allowing the reversing roller to slip and counter-rotate with the advancing roller when friction applied by the advancing roller on the pinched reversing roller exceeds a preset value. Overriding roller mounted therein allows a sheet to pass over a roller when the rollers are separated and to remain idle when the rollers are pinched.

10 Claims, 5 Drawing Sheets

SHEET SEPARATOR

The present invention relates generally to printing mechanisms and more particularly to a sheet separator for a printing mechanism.

BACKGROUND OF THE INVENTION

Sheet feeding assemblies engage and remove sheets of paper or other media from a stack and feed the sheets along a path to a printing zone, copying zone, scanning zone or the like.

During operation, a sheet picker, usually a small roller having a high friction rubber circumference, engages and removes the uppermost sheet from a stack and feeds it edgewise along a feed path through to a sheet separator.

The sheet separator ensures that only one sheet is fed along the sheet path and separates any multiple sheets. A common type of sheet separator includes an advancing roller aligned adjacently and pinched with a reversing roller, both rollers have a high friction gripping surface. The advancing roller is driven in a sheet advancing direction while the reversing roller is driven to move a sheet in a reverse direction. The advancing roller provides a stronger positive force between the two rollers such that when they are pinched with a single sheet therebetween, the advancing roller causes the reversing roller to change direction and move in unison to move the sheet forward. The reversing roller is coupled to a torque limiter, which allows the reversing roller to slip with respect to the drive and hence to counter-rotate.

Where more than one sheet is picked and passes through to the sheet separator, the advancing roller engages with the top-most sheet while the reversing roller engages with the bottom-most sheet. The lack of resistance between the sheets means that the advancing roller cannot impart any frictional force to the reversing roller and hence the reversing roller is allowed to rotate in a reversing direction moving the bottom most sheet backwards while the top-most sheet is moved forward.

The feeding assembly must be able to quickly and efficiently feed each individual sheet in the queue to the printing, copying or scanning zone without creating a backlog and without jamming. This is particularly important where the sheets to be fed are original documents to be copied or scanned and cannot risk being damaged.

Generally, these sheet separators work well but are limited in the speed at which they can advance paper. This limitation is based on the limitations of the torque limiter, which will only allow the reversing roller to counter-rotate up to a certain speed dictated by the torque limiter's working mechanism.

It is therefore desirable to produce a sheet separator that can effectively function at high feeding speeds.

SUMMARY OF THE INVENTION

In one aspect, a sheet separator includes an advancing roller driven to rotate to move a sheet forwards along a sheet path. A reversing roller is driven to rotate to move a sheet backwards along the path. The reversing roller and advancing roller are mounted adjacently and are relatively movable between a pinched position and a separated position. The reversing roller has a torque limiter for allowing the reversing roller to slip and counter-rotate with the advancing roller when friction applied by the advancing roller on the pinched reversing roller exceeds a preset value. Overriding means mounted with one of the advancing or reversing rollers allows a sheet to pass over that roller when the rollers are separated and to remain idle when the rollers are pinched.

DETAILED DESCRIPTION OF PREFERRED EMBODIMENT

Figure 1A:
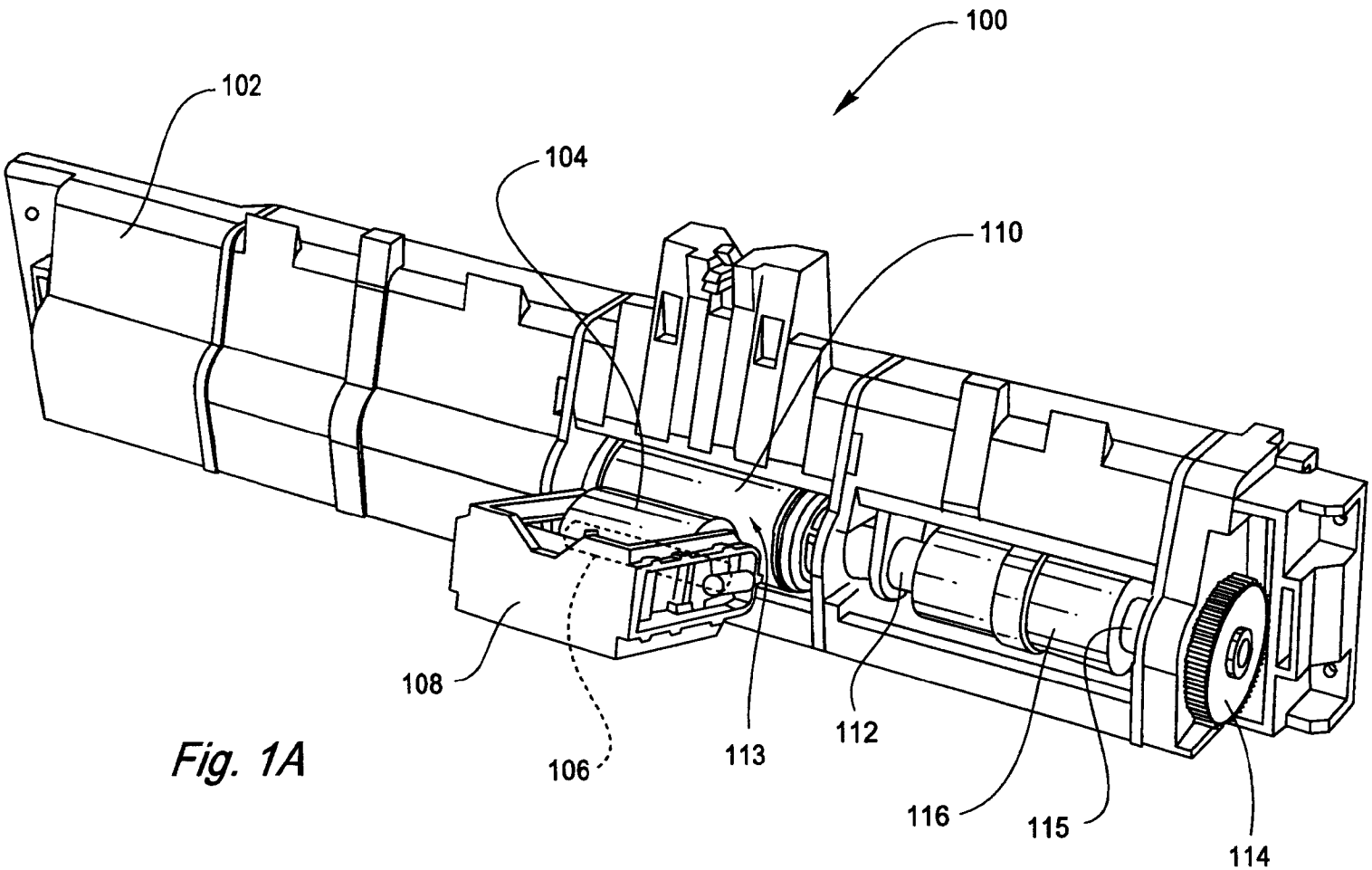
FIG. 1A is a perspective view of a sheet separator according to an embodiment of the present invention.

FIG. 1A illustrates a sheet separator 100 suitable for use in a larger main machine, such as a printer, copier, scanner or the like. The sheet separator feeds and separates sheets through to an action zone which, using the previously mentioned examples, would be a printing zone, copying zone or scanning zone respectively.

FIG. 1A illustrates an elongated support housing 102 mounted at the sheet in-take end of the main machine (not shown) and adjacent to a sheet media tray (not shown). A sheet picker (not shown) picks sheets from the media tray and forwards the sheets to the sheet separator 100.

Support housing 102 supports a reversing roller 110 mounted on a reversing roller shaft 112. A bracket 108 supports an advancing roller 104 mounted on an advancing roller shaft 106.

Bracket 108 is mounted to the larger machine (not shown) and is movable with respect to the housing 102 such that advancing roller 104 is movable towards and away from reversing roller 110 to separate the two rollers 104,110. Bracket 108 is movable by way of a cam assembly (not shown) and is driven by a dedicated motor (not shown). Reversing roller 110 remains stationary in support housing 102 and is exposed to advancing roller 104 through housing opening 113.

In this embodiment the roller that is movable to form a separation (also known as a separating roller), is the advancing roller 104, while the stationary, fixed roller is the reversing roller 110. However, it is possible to interchange the two rollers.

Movement of bracket 108 means that the gap between advancing roller 104 and reversing roller 110 can be adjusted between a "pinched" position, where the rollers are directly in contact (whether or not they are pinching several sheets of media in between), and a fully separated position where there is no contact between the rollers. The rolling surface on the circumference of both the advancing and reversing rollers 104, 110 is lined with a high friction material for gripping and moving sheets of media in the rolling direction.

Both the advancing and reversing rollers 104, 110 are driven in respective sheet forwarding and sheet reversing directions by a motor (not shown) coupled to the shafts by a gear train. This motor simultaneously drives the advancing roller 104, reversing roller 110 and the sheet picker. A large toothed gear 114, which is part of the gear train, is illustrated in FIG. 1A mounted on a driving shaft 115 to drive reversing roller 110.

The advancing roller 104 is designed to forward a sheet more positively than the reversing roller 110 reverses a sheet. This is made possible by the reversing roller 110 being designed to slip with respect to the shaft or driving means and change rotating directions to rotate with the advancing roller and move a sheet forward when the torque applied by the advancing roller on the reversing roller exceeds a certain limit.

In a simple system torque slipping may be produced by mounting the reversing roller on its shaft in a gripping manner where the friction grip can be adjusted so that a torque applied on the reversing roller will cause the reversing roller to ungrip and slip with respect to its shaft when the torque exceeds a predetermined value. A more accurate and reliable means for allowing the reverse roller to slip with respect to the driving motor involves using a torque limiter.

A torque limiter 116, or torque clutch, is illustrated in FIG. 1A coupled in line with the reversing roller shaft 112 and the driving shaft 115, which are also co-axial. The torque limiter 116 allows the reversing roller shaft 112 to slip with respect to the driving shaft 115 when the torque demand on the reversing roller 110 exceeds a pre-set value. This value is generally defined as being lower than the friction imparted on the reversing roller 110 by the pinched advancing roller 104 where no sheet or one sheet of media is pinched therebetween. Hence, when the advancing roller 104 is pinched with the reversing roller 110 and there is zero or one sheet therebetween, the reversing roller 110 will slip and rotate in unison with the stronger advancing roller 104 in the sheet advancing direction.

The pre-set torque value is also defined as being higher than the friction on the reversing roller 110 imparted by a sheet pinched between the rollers where the sheet is one of two or more sheets passing between the pinched rollers. Hence, if two or more sheets are picked and pass between the rollers the advancing roller 104 continues to advance the top sheet but slippage between the multiple sheets reduces the friction imparted on the reversing roller 110 to produce a torque lower than the pre-set torque value. Accordingly, the reversing roller 110 continues to rotate in a reversing direction thereby moving the sheet adjacent to it backwards.

Figure 1B:
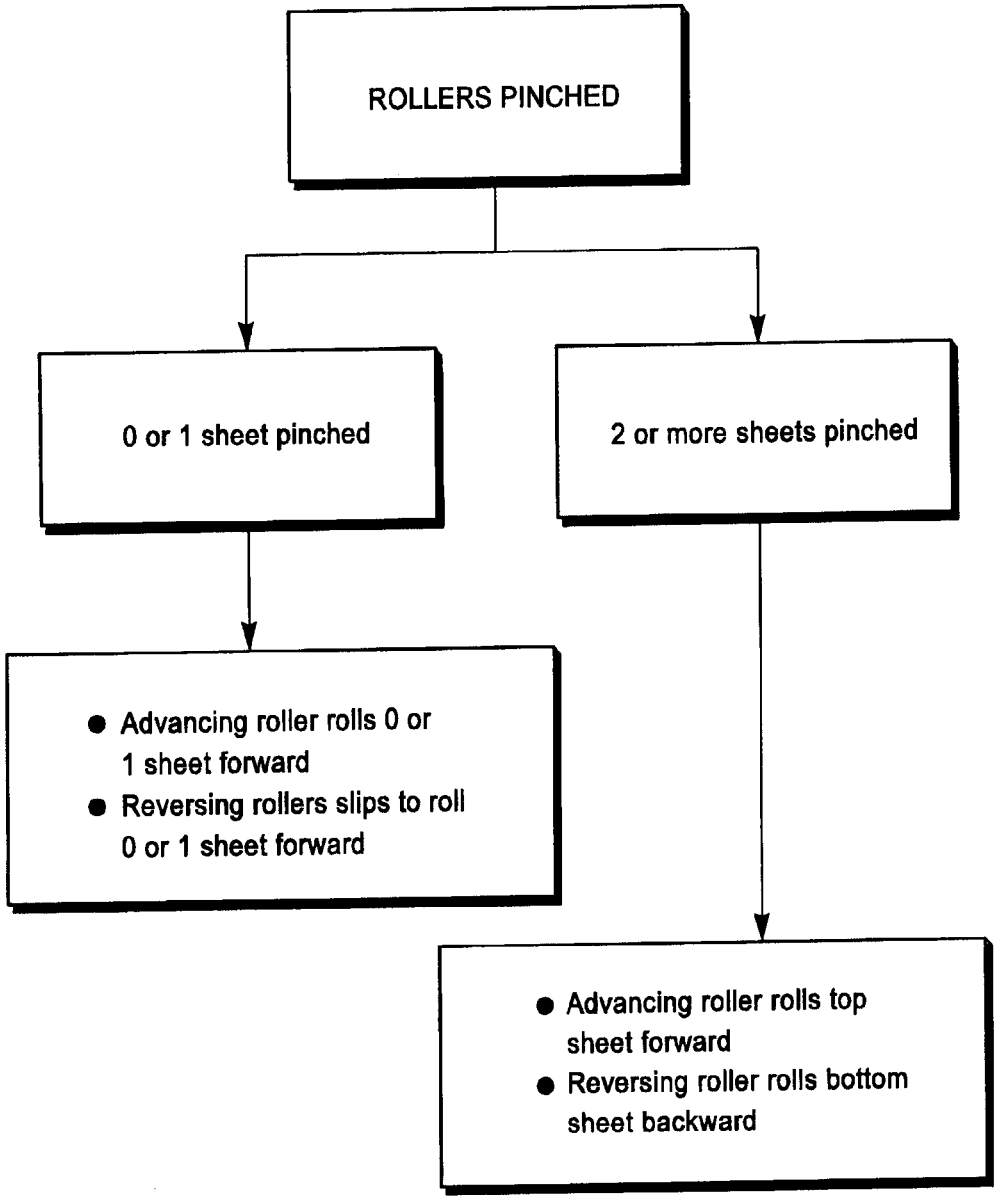
FIG. 1B is a flow chart representing operating conditions of the sheet separator in accordance with an embodiment of the present invention.

The two scenarios described above can be summarized as follows and are represented by the flow chart of FIG. 1B:

A. When the rollers are pinched and 0 or 1 sheet is fed into the sheet separator, the advancing roller rotates in a sheet forwarding direction whereby the reversing roller counter rotates to forward the sheet in the same direction.

B. When the rollers are pinched and two or more sheets are fed therebetween—the advancing roller rotates in the sheet forwarding direction; and the reversing roller rotates in the same direction to move additional sheets in the opposite direction.

Figure 2A:
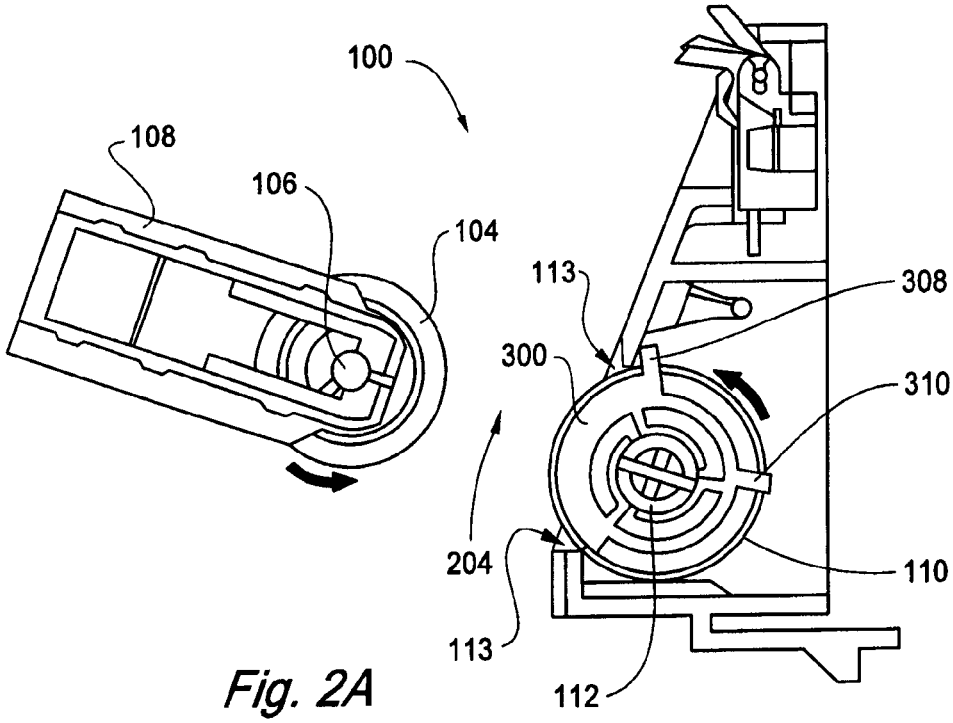
FIG. 2A is a side sectional view of the sheet separator illustrating separated rollers in accordance with an embodiment of the present invention.
Figure 2B:
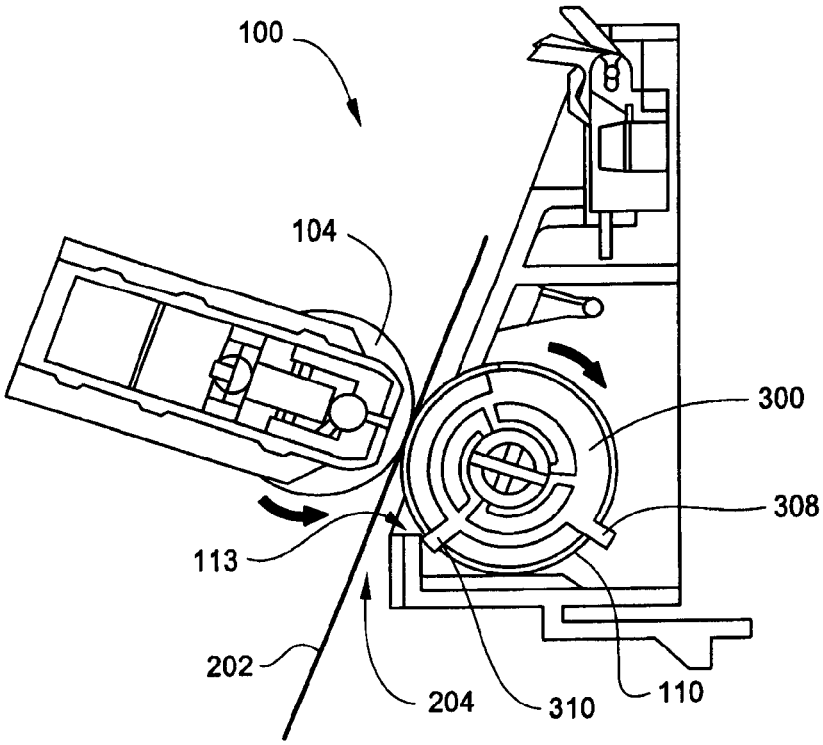
FIG. 2B is a side sectional view of the sheet separator illustrating pinched rollers with one sheet of media there between in accordance with an embodiment of the present invention.
Figure 2C:
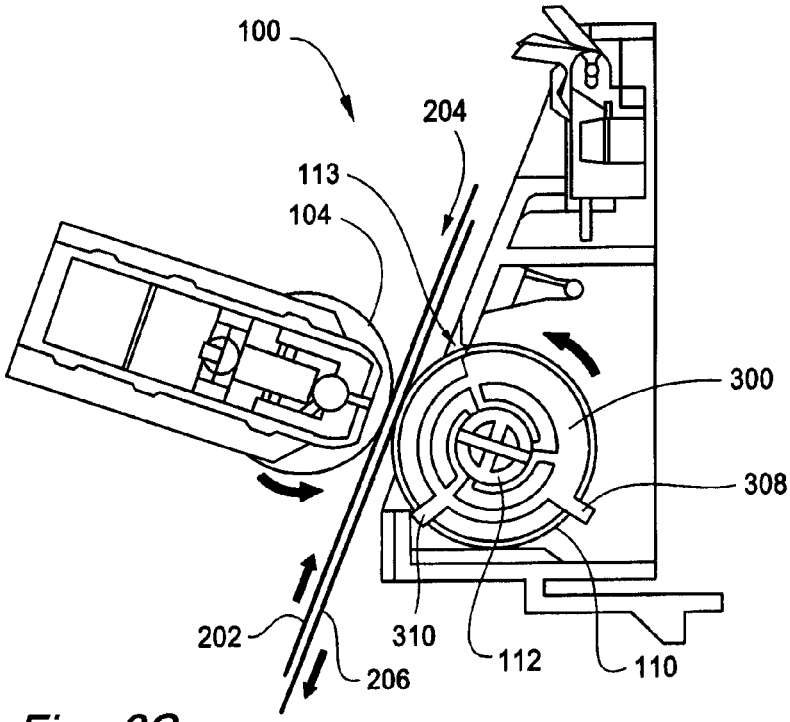
FIG. 2C is a side sectional view of the sheet separator illustrating pinched rollers with two sheets of media there between in accordance with an embodiment of the present invention.

For clarity, the above scenarios are illustrated in FIGS. 2A to 2C. FIG. 2A illustrates a sectional side view of the sheet separator 100 with the advancing and reversing rollers 104, 110 separated. The arrows illustrated in this drawing indicate the rotational directions of the respective rollers in a free rotating state that is, a frictionless state.

In FIG. 2B the advancing roller 104 has moved towards the reversing roller 110 and the two rollers are pinched. A sheet of media 202, typically paper, is shown between the rollers. The advancing roller 104 rotates in an anti-clockwise direction to advance sheet 202 up the sheet path 204, which in this embodiment is inclined to feed sheets upwardly. The components of the sheet separator are fine tuned such that even one sheet of media provides sufficient friction to trigger the torque limiter, and rotate reversing roller 110 in a clockwise direction in unison with the advancing roller to move the sheet 202 up along sheet path 204.

FIG. 2C illustrates the second scenario where the advancing roller 104 and reversing roller 110 are pinched but two sheets 202 and 206 have been fed inbetween the pinched rollers. In this scenario the advancing roller rotates in a clockwise direction to advance top sheet 202 in an upwardly direction. This time friction on the reversing roller falls below the limit of the torque limiter as a result of the sliding friction between top-sheet 202 and bottom-sheet 206. Accordingly, the reversing roller also rotates in an anti-clockwise direction thereby prohibiting bottom-sheet 206 from advancing along the sheet path and instead returning the bottom-sheet 206 back down the path as indicated by the arrow corresponding to bottom sheet 206.

In this embodiment of the sheet separator, one other sheet separator scenario may be adopted to increase the sheet feeding speed. Namely, the rollers can be separated and a higher sheet feeding speed can be achieved by relying on the advancing motion of the sheet picker alone. This high speed comes at a sacrifice to the reliability of smooth and efficient feeding of one sheet at a time without damage.

Figure 2D:
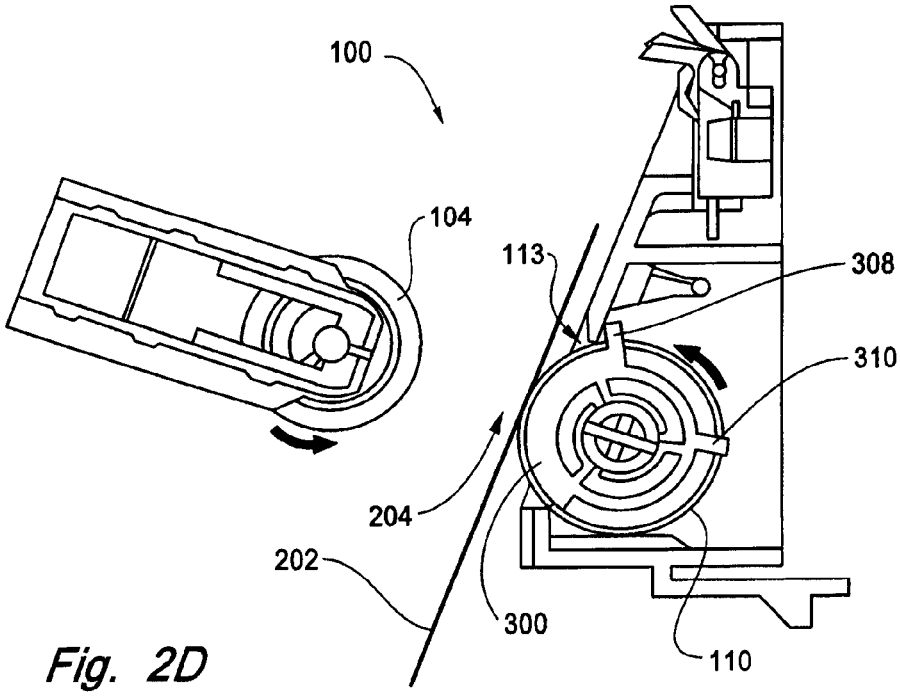
FIG. 2D is a side sectional view of the sheet separator illustrating separated rollers with one sheet of media there between in accordance with an embodiment of the present invention.

This third scenario is illustrated in FIG. 2D, which shows the advancing roller 104 separated by a gap from reversing roller 110. Although not shown, the sheet picker in this diagram would be located below the sheet separator 100 to advance sheet 202 upward along path 204.

However, providing this kind of gap causes problems with sheet kinking and jamming in the gap. This is compounded by the fact that the reversing roller 110 continues to rotate in a reversing direction that, despite the gap, tends to discourage a sheet from moving forward. The reversing roller 110 continues to rotate because it is driven by the same motor that drives the sheet picker. However, even if the reversing roller 110 stopped rotating sheet jamming still occurs because the sheets contact the gripping surface of the roller.

However, in an embodiment of the sheet separator, the reversing action or gripping properties of the reversing roller are overridden by two override rollers 300 that are activated in this scenario to allow a sheet 202 to freely pass through the gap between the rollers and over the reversing roller. In effect, the construction of the override rollers 300 are such that they remain idle when the rollers are pinched, not interfering with the pinched feed operation, but become active when the rollers are separated.

Figure 3A:
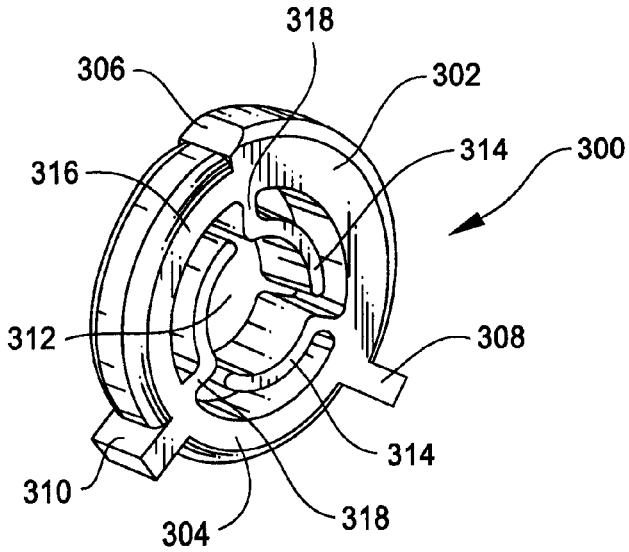
FIG. 3A is a perspective view of an override roller in accordance with an embodiment of the present invention.
Figure 3B:
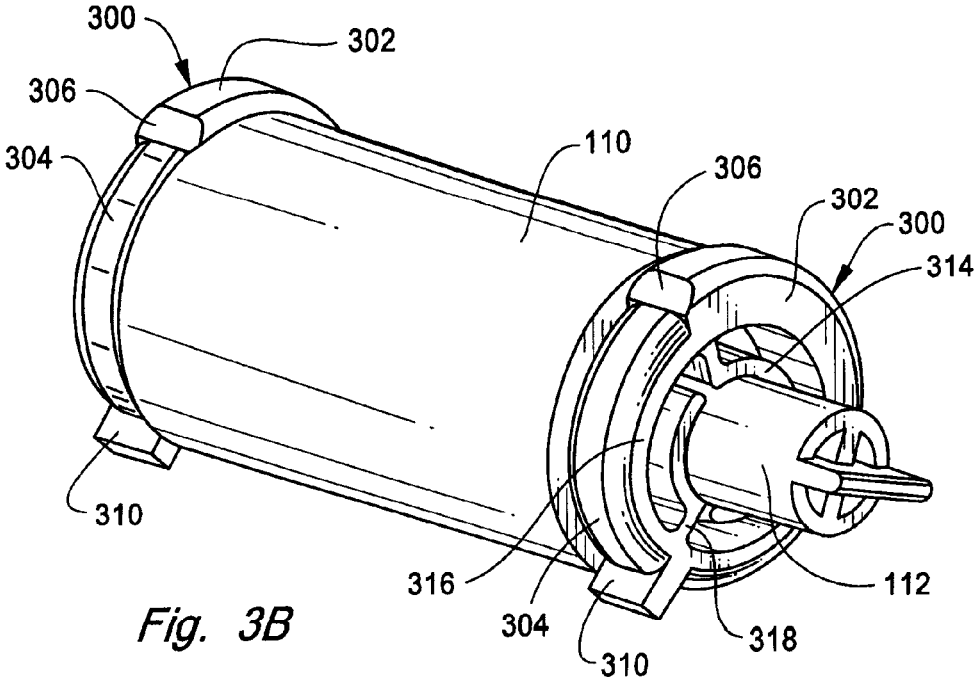
FIG. 3B is a perspective view of a reversing roller and override rollers of the sheet separator in accordance with an embodiment of the present invention.

FIG. 3A illustrates override roller 300. FIG. 3B illustrates an overriding roller 300 mounted at each end of reversing roller 110 and coaxial therewith on shaft 112. FIGS. 2A to 2D also illustrate in side profile the override roller 300.

Override roller 300 is substantially annular and wheel-like in form. The roller 300 is made of moulded plastic and the surface of the circumference of the override roller 300 is moulded to be relatively smooth and having little friction. The circumference of the roller is also uneven such that one segment 302 of the circumference surface has a larger radius than the other, smaller radius segment 304. Large radius segment 302 spans from a step 306 to a first detent 308, spaced away at around one third of the circumference length of the override roller 300. The other two thirds of the roller are defined by the small radius segment 304. The small and large radius segments 304, 302 are formed such that when the override roller 300 is mounted against the end of the reversing roller 110, the small radius segment 304 is smaller than the radius of the reversing roller 110. This is best illustrated in FIG. 3B. On the other hand, the large radius segment 302 is greater than the radius of the reversing roller 110 such that it protrudes above the circumference surface of the reversing roller 110.

A second detent 310 on the small radius segment 304 is spaced from the first detent 308 by approximately one third of the circumference. Detents 308, 310 protrude radially outward from the circumference of the override roller 300.

As best illustrated in FIG. 3A, at its centre the override roller 300 has a bore 312, wherein a vertex of the override roller 300 (being the common vertex of both large radius and small radius segments 302,304) lies along the longitudinal or central axis of the bore 312. The bore is defined by three curved and spaced flanges 314 that are adapted to bear against and conform to the reversing roller shaft 112. Flanges 314 are connected to an inner circumference 316 of the override roller 300 by webs 318.

FIG. 3B best illustrates override roller 300 mounted on reversing roller shaft 112 with flanges 314 gripping shaft 112 with an element of force. The force exerted between the shaft 112 and the flanges 314 is a low frictional force whereby when an amount of friction is applied onto the override roller 300, the roller 300 will slip on the shaft 112 with respect to the reversing roller 110. The low friction engagement of the override roller 300 on shaft 112 is assisted by an amount of flexibility in flanges 314 which allow override roller 300 to slip more easily.

In scenario A, (FIG. 2B) when the rollers are pinched and a single sheet is passed there between, the reversing roller 110 slips and rotates in a clockwise direction in unison with the advancing roller. In this scenario, override roller 300 rotates together with reversing roller 110 in a clockwise direction until its second detent 310 comes to a stop against support housing 102. At this point reversing roller 110 continues to rotate in a clockwise direction while override roller 300 slips on the reversing roller shaft and is stopped up against the housing. In this position, the small radius segment 304 is exposed to the sheet path 204 through housing opening 113, but since it is smaller than the radius of the reversing roller it does not interfere with the feeding and separation of the sheet. Effectively, the override roller 300 is idle in this scenario.

In scenario B, (FIG. 2C) where the rollers are pinched and two sheets 202 and 206 are fed between the pinched rollers, the reversing roller 110 meets little friction from bottom sheet 206 and hence rotates against the advancing roller in an anti-clockwise direction to move the bottom sheet 206 back down the sheet path. Override roller 300 follows the rotation of the reversing roller until step 306 on the override roller's circumference rotates towards the housing opening 113 to become exposed to the sheet path. However, while the reversing roller 110 continues to rotate in an anti-clockwise direction the override roller 300 stops with step 306 exposed through the opening; the friction created by the bottom sheet 206 abutting against step 306 is sufficient to provide resistance and cause override roller 300 to slip on the reversing roller shaft 112. Override roller 300 slips on shaft 112 until bottom sheet 206 is moved back until its turn to advance along the sheet path. Once multiple sheets have been removed or realigned such that only one sheet is pinched between the rollers, the reversing roller 110 and override roller 300 return to their positions as illustrated in scenario A in FIG. 2B. The override roller is also idle in this scenario.

In the third scenario (FIG. 2D) where the rollers are separated and a single sheet is passed through the gap, the reversing roller 110 rotates in its preferred direction to reverse any sheets back down the sheet path. Since it meets no resistance reversing roller 110 continues to rotate in this direction. Override roller 300 partially rotates with the reversing roller until its first detent 308 stops against support housing 102 just above the housing opening 113. Here, override roller 300 meets with resistance and slips on reversing shaft 112. While reversing roller 110 continues to rotate in an anti-clockwise direction override roller 300 remains stationary in this position where the larger radius segment 302 is exposed to the sheet path 204. With the radius of segment 302 larger than the radius of the reversing roller, sheet 202 will come into contact with only the override rollers on either side of the reversing roller and not the reversing roller. The circumferential surface of the override rollers 300, and particularly the surface of the large radius segments 302, is smoother and has a lower friction than the gripping surface of the reversing roller 110. Accordingly, the override rollers 300 will permit a sheet of media to pass over without any resistance thereby allowing smooth and continuous high speed feeding without jamming.

In the above described embodiment of the sheet separator 100, the reversing roller 110 remains stationary in the housing 102 while the advancing roller 104 is movable on bracket 108 towards and away from the reversing roller 110 between a pinched position and a separated position. However, it is foreseeable that the positions of the rollers 104, 110 in the housing are reversed, namely that the advancing roller 104 remains stationary while the reversing roller 110 is mounted on a movable bracket.

In this case, when the rollers are separated and the sheet picker feeds sheets of media at high speeds through the gap, the sheets pass over the advancing roller. While the advancing roller would still advance the sheets in a forward direction, jamming would still occur because the speeds at which the advancing roller operates are still lower than that of the sheet picker and hence the advancing roller cannot keep up with the sheet picker. Hence, an override roller mounted co-axially with the advancing roller would be useful in this embodiment.

The above embodiments disclose a sheet separator having two override rollers: one at each end of the reversing roller, or the advancing roller as the case may be. However, it is possible for the sheet separator to operate with only one override roller at one end of the reversing or advancing roller. Alternatively, another construction may involve having two shorter reversing rollers and locating one override roller inbetween the two rollers. These are some examples of possible configurations for the sheet separator.

The present sheet separator operates reliably to feed sheets at higher speeds without causing paper jams or concentrated stress points on the sheet. It feeds sheets smoothly over a roller, whether or not it is rotating, to pass efficiently along the sheet path.

The sheet separator provides reliability and confidence in fast feeding sheets into a main apparatus. Sheet media and particularly original documents can be safely fed and separated, even at high speeds through the sheet separator.

In another embodiment, the sheet separator includes a pair of adjacent rollers. One of the rollers is a separating roller in that it is mounted to move towards and away from the other, stationary, roller between a contacting position and a separated position. One of the rollers is driven to move a sheet forward along a sheet path. The other roller is driven to reverse a sheet back down the path and has a friction slipping means which will allow the reversing roller to slip and counter-rotate with the forwarding roller when the forwarding roller applies sufficient friction on the reversing roller. An override means is mounted with the stationary roller. The override means remains idle when the rollers are in contact and becomes active when the rollers are separated to allow a sheet to pass over the stationary roller.

In yet another embodiment, the sheet separator includes an advancing roller driven on a shaft to move a sheet in a forward direction along a sheet path. A reversing roller is driven on a shaft to move a sheet in a backward direction if more than one sheet simultaneously passes through the sheet separator. The advancing and reversing rollers are mounted to be mutually movable between a pinched position and a separating position. A torque limiter coupled to the shaft of the reversing roller allows the reversing roller to slip and move in the same direction as the advancing roller when the advancing roller applies friction to the reversing roller. Overriding means is mounted with the reversing roller and remains inactive when the advancing and reversing rollers are pinched and becomes active when the advancing and reversing rollers are separated to allow a sheet to pass over the reversing roller.

Without departing from the spirit of the invention and scope of the attached claims, variations of the described structure and geometry of the sheet separator are possible, and envisaged, depending on the application and structure of the machine in which the sheet separator is mounted and the media to be forwarded and separated.

The claims defining the invention are as follows:

1. A sheet separator comprising:

an advancing roller driven to rotate to move a sheet forwards along a sheet path;

a reversing roller driven to rotate to move a sheet backwards along the sheet path, wherein the reversing roller and advancing roller are relatively moveable between a pinched position, whereby the advancing and reversing rollers are in contact with each other, and a separated position, whereby the advancing and reversing rollers are not in contact with each other;

the reversing roller being coupled to a torque limiter, which is configured to allow the reversing roller to slip and counter-rotate with the advancing roller when friction applied by the advancing roller on the reversing roller during the pinched position exceeds a preset value; and at least one override roller mounted co-axially with the reversing roller, wherein said at least one override roller has an outer circumferential surface, which includes a first surface segment with a first radius that is larger than the radius of the reversing roller and a second surface segment with a second radius that is smaller than the radius of the reversing roller, and wherein the override roller is rotatable to expose said first surface segment or said second surface segment to the sheet path such that, when the advancing and reversing rollers are separated, said first surface segment is exposed to the sheet path, and when the advancing and reversing rollers are in the pinched position, said second surface segment is exposed to the sheet path.

2. The sheet separator claimed in claim 1, wherein there are two override rollers mounted at opposite sides of the reversing roller.

3. The sheet separator claimed in claim 1, wherein the first surface segment has a coefficient of friction that is lower than the coefficient of friction of the outer surface of the reversing roller.

4. The sheet separator claimed in claim 3, wherein the first surface segment is formed from moulded plastics.

5. The sheet separator claimed in claim 1, wherein the override roller and the reversing roller are mounted on a common shaft and the override roller is engaged on the common shaft with an amount of friction such that when rotational resistance is met, the override roller slips with respect to the reversing roller.

6. The sheet separator claimed in claim 1, wherein the override roller includes holding flanges that grip around the common shaft with a frictional holding force that allows the override roller to slip on the common shaft.

7. The sheet separator claimed in claim 1, wherein the outer circumferential surface of the override roller has a circumferential length, and the override roller has two detents extending radially outward from the outer circumferential surface and spaced apart by approximately one third of the circumferential length, the detents limiting rotational movement of the override roller in opposite rotational directions.

8. The sheet separator claimed in claim 7, wherein the first surface segment spans around approximately one third of the circumferential length while the second surface segment extends around approximately two thirds of the circumferential length.

9. A sheet separator comprising:

an advancing roller configured to move a sheet forwards along a sheet path;

a reversing roller configured to move a sheet backwards along the sheet path, the reversing roller and advancing roller being movable between a pinched position, whereby the advancing and reversing rollers are in contact with each other, and a separated position, whereby the advancing and reversing rollers are not in contact with each other; and at least one override roller mounted co-axially with the reversing roller, wherein said at least one override roller has an outer circumferential surface, which includes a first surface segment with a first radius that is larger than the radius of the reversing roller and a second surface segment with a second radius that is smaller than the radius of the reversing roller, and wherein said at least one override roller is rotatable to expose said first surface segment or said second surface segment to the sheet path such that, when said first surface segment is exposed to the sheet path, the override roller interferes with the operation of the advancing and reversing rollers, and when said second surface segment is exposed to the sheet path, the override roller does not interfere with the operation of the advancing and reversing rollers.

10. A sheet separator comprising:

an advancing roller configured to move a sheet forwards along a sheet path;

a reversing roller configured to move a sheet backwards along the sheet path, the reversing roller and advancing roller being movable between a pinched position, whereby the advancing and reversing rollers are in contact with each other, and a separated position, whereby the advancing and reversing rollers are not in contact with each other; and at least one override roller mounted coaxially with the advancing roller, wherein said at least one override roller has an outer circumferential surface, which includes a first surface segment with a first radius that is larger than the radius of the advancing roller and a second surface segment with a second radius that is smaller than the radius of the advancing roller, and wherein said at least one override roller is rotatable to expose said first surface segment or said second surface segment to the sheet path such that, when said first surface segment is exposed to the sheet path, the override roller interferes with the operation of the advancing and reversing rollers, and when said second surface segment is exposed to the sheet path, the override roller does not interfere with the operation of the advancing and reversing rollers.

* * * * *